US006065803A

United States Patent [19]

Li et al.

[11] Patent Number: 6,065,803

[45] Date of Patent: May 23, 2000

[54] SEAT BACK TILT CONTROL APPARATUS

[75] Inventors: Wei Guang Li, Clemmons; Laurence V. O'Leary, Pittsboro, both of N.C.

[73] Assignee: L&P Property Management Company, South Gate, Calif.

[21] Appl. No.: 09/305,554

[22] Filed: May 5, 1999

[51] Int. Cl.[7] ..... A47C 3/00

[52] U.S. Cl. ..... 297/301.3; 297/285

[58] Field of Search ..... 297/354.1, 285, 297/300.4, 301.1, 301.3, 302.3, 303.3, 463.1, 463.2; 29/428

[56] References Cited

U.S. PATENT DOCUMENTS

| | | |
|---|---|---|
| 362,796 | 5/1887 | Tait . |
| 2,087,253 | 7/1937 | Herold . |
| 2,087,254 | 7/1937 | Herold . |
| 2,471,024 | 5/1949 | Cramer . |
| 2,711,211 | 6/1955 | Tidcombe . |
| 2,991,125 | 7/1961 | Lie . |
| 3,136,580 | 6/1964 | Parrott . |
| 3,464,663 | 9/1969 | Blomborg . |
| 3,544,160 | 12/1970 | Karasick . |
| 3,552,796 | 1/1971 | Williams . |
| 3,598,354 | 8/1971 | Williams . |
| 3,806,193 | 4/1974 | Faiks . |
| 4,101,166 | 7/1978 | Rauschenbrg et al. . |
| 4,235,408 | 11/1980 | Sapper . |
| 4,718,726 | 1/1988 | Estrowski et al. . |
| 4,865,384 | 9/1989 | Desanta . |
| 4,938,532 | 7/1990 | Burgess . |
| 4,981,326 | 1/1991 | Heidmann . |
| 4,986,601 | 1/1991 | Inoue . |
| 5,069,496 | 12/1991 | Kunh et al. . |
| 5,100,201 | 3/1992 | Becker, III et al. . |
| 5,524,966 | 6/1996 | Piretti . |
| 5,580,127 | 12/1996 | Piretti . |
| 5,810,439 | 9/1998 | Roslund, Jr. . |
| 5,902,012 | 5/1999 | Han . |

*Primary Examiner*—Milton Nelson, Jr.
*Attorney, Agent, or Firm*—Shook, Hardy & Bacon L.L.P.

[57] ABSTRACT

A tilt control apparatus is provided for use on a chair having a base and a backrest, and includes a center retainer from which a pair of torsion bar segments protrude. A tubular outer casing is received over each torsion bar segment and is affixed to the center retainer, and an end bar retainer is received on the distal end of each torsion bar segment for rotation therewith. A structure is provided for restricting axial and rotational movement of the end retainers relative to the outer casings, holding the end retainers in place on the apparatus and permitting the torsion bar segments to be pre-torqued, if desired. The center retainer and outer casings are adapted for securement together to either the base or backrest of the chair, and the end retainers are adapted for securement to the other such that the backrest can be tilted relative to the base between an upright position and a tilted position, the torsion bar segments biasing the end retainers in a direction adapted to return the backrest to the upright position. A method of assembling a tilt control apparatus is also provided, wherein the torsion bar segments are pre-torqued to set the magnitude of the biasing force exerted on the backrest.

14 Claims, 2 Drawing Sheets

SEAT BACK TILT CONTROL APPARATUS

BACKGROUND OF THE INVENTION

The present invention relates generally to chair control mechanisms, and more particularly to a tilt control apparatus employing a torsion bar adapted to bias a backrest of the chair toward an upright position.

It is conventional to provide a chair having a backrest that is supported on a base for pivotal movement about a horizontal axis between upright and reclined positions such that a person can recline to a limited ex-tent while seated in the chair. It is further conventional to employ a tilt control apparatus in the chair, wherein the tilt control apparatus is connected between the base and the backrest of the chair, and includes a spring that biases the backrest toward the upright position relative to the base.

More recently, such tilt control apparatuses have be designed for use on relatively inexpensive, lightweight stacking chairs of the type commonly used by convention hall owners and others for large gatherings or services. This type of chair must be stacking to facilitate storage of large numbers of chairs, while being easy to unstack and position for use.

BRIEF SUMMARY OF THE INVENTION

In order for a tilt control apparatus to have utility in a stacking chair of this known type, it is important that the apparatus be compact while providing the necessary structural rigidity to the chair required to support reclining movement of the backrest. In addition, the apparatus must be inexpensive to produce, easy to install, and preferably capable of being preset to any desired torque in order to deliver a desired magnitude of resistance to reclining movement.

It is an object of the present invention to solve these technical problems left unaddressed by the prior art, and to provide a tilt control apparatus adapted for use on a stacking chair or the like for permitting and controlling tilting or reclining movement of a backrest of the chair.

In accordance with these and other objects evident from the following description of a preferred embodiment of the invention, the inventive tilt control apparatus includes a center retainer having a pair of opposed axial ends, a torsion bar segment protruding from each axial end of the center retainer along a longitudinal axis of the retainer, a tubular outer casing received over each torsion bar segment and affixed to the center retainer, and an end retainer received on the distal end of each torsion bar segment for rotation therewith. Structure is provided in the apparatus for restricting axial and rotational movement of the end retainers relative to the outer casings, wherein the center retainer and outer casings can be secured together to either the base or backrest, and the end retainers are secured to the other such that the backrest can be tilted relative to the base between an upright position and a tilted position.

By providing a construction in accordance with the present invention, numerous advantages are realized. For example, by providing a center retainer that is separate from but affixed to a pair of outer casings, it is possible to torque the torsion bar segments to any desired degree relative to the casings during assembly, and to fix the center retainer and outer casings together in the preset orientation such that the apparatus provides the desired magnitude of biasing force on the backrest of a chair onto which the apparatus is installed.

In accordance with another aspect of the invention, a method is provided for assembling a tilt control apparatus, and includes the steps of mounting a pair of torsion bar segments on a center retainer and sliding a tubular outer casing over each torsion bar segment. An end retainer is then fit on the distal end of each torsion bar segment, wherein the tubular outer casings and end bar retainers each present radially extending apertures into which pins are inserted to restrict axial and rotational movement of the end retainers relative to the outer casings. Other steps of the method include rotating the center retainer relative to the outer casings and the end retainers to pre-torque the torsion bar segments, and securing the center retainer to the outer casings while maintaining the pre-torque on the torsion bar segments.

By employing a method in accordance with the present invention, it is possible to apply any desired magnitude of torque to the torsion bar segments during assembly, and to fix the segments at the desired magnitude.

BRIEF DESCRIPTION OF THE SEVERAL VIEWS OF THE DRAWING

The preferred embodiment of the present invention is described in detail below with reference to the attached drawing, wherein.

DETAILED DESCRIPTION OF THE INVENTION

Figures 1, 2, 3, 4, 6:
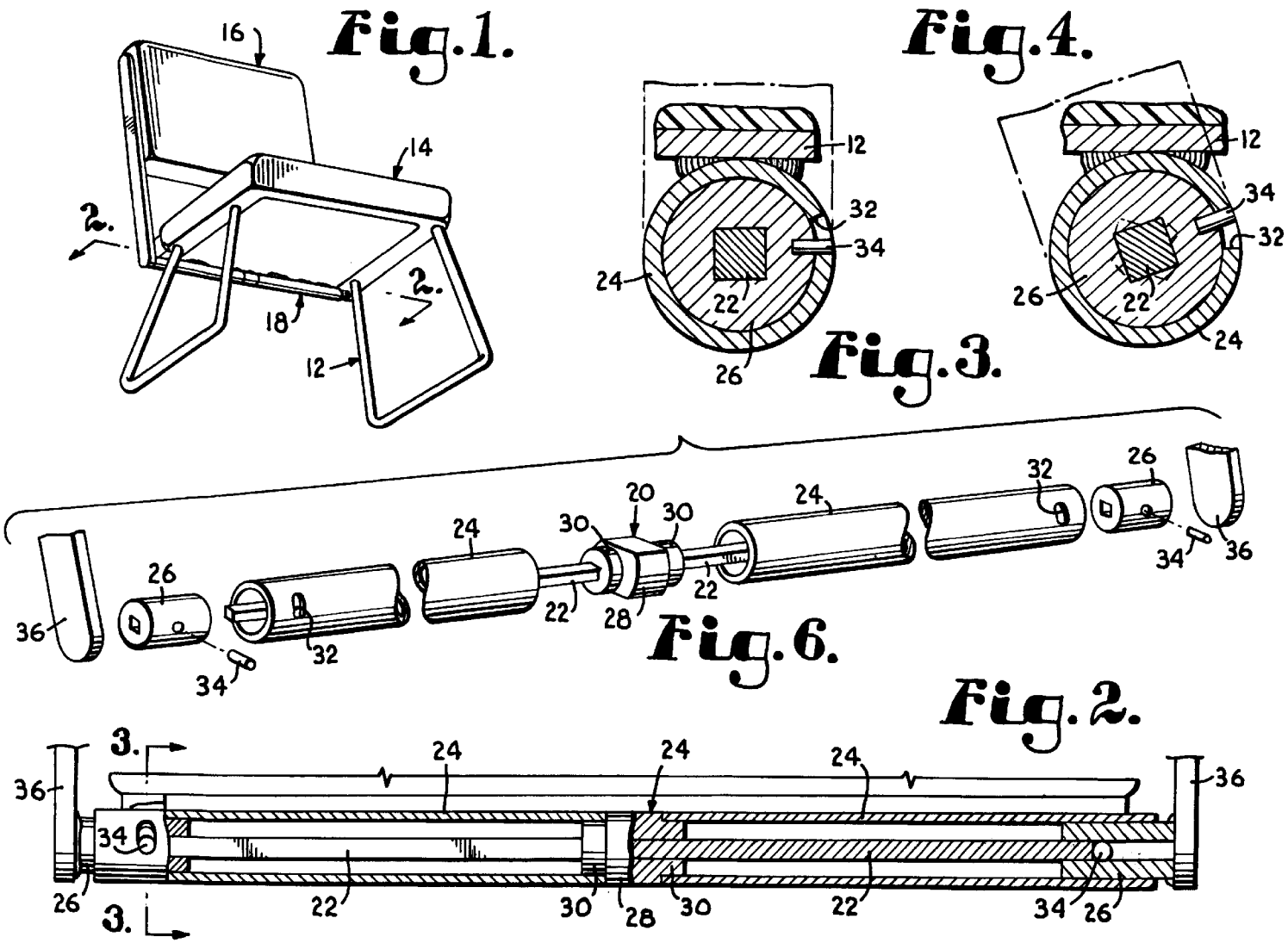
FIG. 1 is a perspective view of a stacking chair including a tilt control apparatus constructed in accordance with the preferred embodiment of the present invention.
FIG. 2 is a sectional view of the chair taken along line 2—2 of FIG. 1, illustrating the backrest of the chair in an upright position.
FIG. 3 is a sectional view of the chair taken along line 3—3 of FIG. 2, illustrating the backrest of the chair in the upright position.
FIG. 4 is a sectional view similar to FIG. 3, illustrating the backrest in a reclined position.
FIG. 6 is a fragmentary exploded perspective view of the tilt control apparatus and backrest.

A stacking chair including a tilt control apparatus constructed in accordance with the present invention is illustrated in FIG. 1, and broadly includes a base 12, a seat 14 supported on the base, and a backrest 16 supported on the base either directly or through the seat.

The chair can take any form, and can be formed of any conventional material, such as wood, metal, synthetic resin material, or any combination thereof. The base 12 presents a plurality of legs on which the chair is supported on the ground, and includes a frame that connects the legs together, adding rigidity to the chair. In the illustrated chair, the seat 14 is secured to the frame of the base while the backrest 16 is supported on the base by the tilt control mechanism 18. As such, the seat remains stationary relative to the base during tilting movement of the backrest. However, it is possible to employ the tilt control apparatus with an alternate chair construction in which the seat and backrest are unitary, and are supported together on the base by the tilt control apparatus for reclining movement relative to the base.

The tilt control apparatus is illustrated in FIG. 6, and broadly includes a center retainer 20, a pair of torsion bar segments 22 received in the center retainer and protruding therefrom, a pair of laterally spaced outer casings 24 received over the torsion bar segments, and a pair of end retainers 26 received in the outer casings and engaging the distal ends of the torsion bar segments. In addition, structure is provided for holding the end retainers 26 in place within the ends of the outer casings, and for permitting a limited degree of relative rotation between the end retainers and the outer casings to accommodate twisting of the torsion bar segments.

The center retainer 20 is formed of metal, and includes a central longitudinal section 28 presenting a relatively large outer diameter, and a pair of axially opposed end sections 30 presenting relatively small outer diameters. The central section 28 presents an outer circumferential surface having non-circular cross-sectional shape, and presents a pair of diametrically opposed flats by which the center retainer can be gripped and rotated by a conventional tool. Any other suitable outer circumferential shape that permits gripping and rotation of the center retainer relative to the outer casings can be employed.

The center retainer 20 presents a pair of longitudinally opposed circular end faces and a longitudinally extending bore intersecting the end faces and passing entirely through the center retainer, as illustrated in FIG. 2. The bore includes a cross-sectional shape corresponding to the cross-sectional shape of the torsion bar segments 22, which is square in the illustrated embodiment, but which could be any shape desired so long as the torsion bar segments can be fixed to the center bar retainer for rotational movement therewith. Alternately, two separate bores could be provided in the retainer, wherein each extends longitudinally inward from one of the end faces to receive one of the torsion bar segments.

The torsion bar segments 22 are preferably defined by a single metal torsion bar, but may alternately be defined by separate torsion bars. In the preferred embodiment, a torsion bar having a square cross-sectional shape is employed, wherein the bar is inserted into the center retainer 20 until two segments of equal length protrude from the end faces of the retainer. If desired, any suitable expedient may be employed to secure the torsion bar or bars in place in the retainer. Such securement insures that the two segments will remain substantially equal in length, balancing the torque exerted on the end retainers during use.

Returning to FIG. 6, the outer casings 24 are substantially identical to one another, and each includes a tubular sleeve presenting opposed ends, an inner diameter sized for sliding receipt on the end sections 30 of the center retainer, and an outer diameter generally equal to the outer diameter of the central section 28 of the retainer 20. The casings 24 are formed of metal, and each includes a circumferentially extending slot 32 that is sized for receipt of a pin 34. Each slot includes a dimension in the longitudinal direction of the apparatus that is substantially equal to the diameter of the pins 34 so that each pin is restricted from longitudinal movement when received in one of the slots. However, the slots 32 are elongated in the circumferential direction of the outer casings to permit a limited range of rotational movement of the pins.

The end retainers 26 are preferably formed of metal, and are substantially the same as one another in shape. Each end retainer is cylindrical, presenting an outer diameter that is slightly smaller than the inner diameter of the outer casings so that the end retainer can be received in and rotate relative to the casings. As shown in FIG. 2, a bore is provided in each end retainer, and extends longitudinally inward from the proximal end face thereof. The bore includes a cross-sectional shape corresponding to the cross-sectional shape of the torsion bar segments, which is square in the illustrated embodiment, but which could be any shape desired so long as the torsion bar segments can be fixed to the center bar retainer for rotational movement therewith. In the illustrated embodiment, the bore extends completely through the end retainer. However, it need only extend into the retainer far enough to accommodate the distal end of the torsion bar segment.

As shown in FIG. 6, each end retainer includes a radially extending bore disposed generally intermediate the ends of the retainer, and the radial bore include a diameter sized for receipt of one of the pins 34. Preferably, the pins are grooved to facilitate securement of the pins in the bores of the end retainers. However, any suitable construction can be employed, and it is possible to secure the pins within the end retainers in any desired manner.

The apparatus is assembled by first mounting the torsion bar or bars on the center retainer 20 so that the torsion bar segments 22 extend from the ends of the retainer along the longitudinal axis. Thereafter, the outer casings 24 are slid over the torsion bar segments and onto the end sections 30 of the center retainer 20. The outer casings are not yet secured or affixed to the center retainer, and thus can be rotated relative to the center retainer to facilitate assembly.

With the casings 24 in place, the end retainers 26 are fit on the distal ends of the torsion bar segments for rotation therewith, and the casings are rotated on the center retainer to align the slots 32 in the casings with the radial apertures in the end retainers 26. Thereafter, the pins 34 are driven into the apertures of the end retainers through the slots 32, and prevent the end retainers from being withdrawn from the casings. In addition, the slots pen-nit only a limited range of relative rotational movement of the end retainers and casings about the longitudinal axis defined by the center retainer.

With the apparatus loosely assembled in the manner described, it is possible to apply a desired magnitude of torque to the torsion bar segments in order that the apparatus will deliver a suitable degree of resistance on the backrest of the chair against reclining movement. This adjustment is accomplished by rotating the center retainer relative to the outer casings and the end retainers to pre-torque the torsion bar segments. For example, by first fixing the rotational position of the casings 24, the end retainers 26 are prevented from rotating with the center retainer and are held in place by the pins 34 that each engage one of the circumferential ends of the corresponding slot 32 at the end of the pin's range of movement. Thereafter, the center retainer 20 can be gripped with a tool that engages the flats, and rotated to apply torque to the torsion bar segments. The magnitude of the torque is directly dependent on the degree of rotation, and can thus be set to any desired magnitude.

Figures 5, 7, 8, 9, 10:
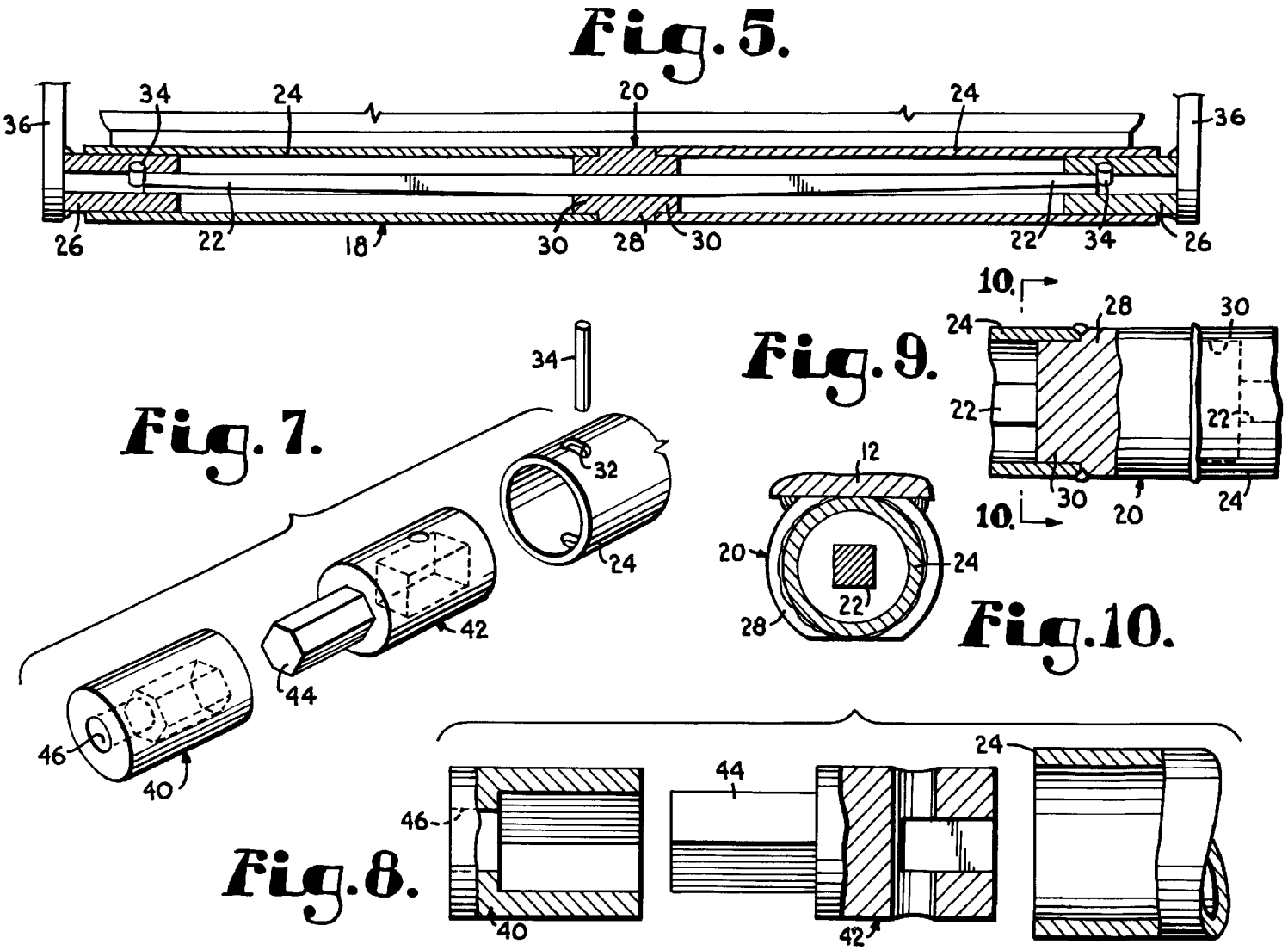
FIG. 5 is a sectional view similar to FIG. 2, illustrating the backrest in a reclined position.
FIG. 7 is a fragmentary exploded perspective view of a tilt control apparatus constructed in accordance with an alternate embodiment of the present invention.
FIG. 8 is a fragmentary exploded sectional view of the tilt control apparatus shown in FIG. 7.
FIG. 9 is a fragmentary elevational view of the tilt control apparatus, illustrating a center retainer forming a part thereof.
FIG. 10 is a sectional view taken along line 10—10 of FIG. 9.

With the casings restrained and the center retainer rotated to the desired angular position, the center retainer and casings are secured together, e.g. by welding as shown in FIG. 9, or by the use of any other suitable expedient, permanently setting the torque by which the end retainers are held in the casings. As such, in order to rotate the end retainers from their end positions defined by the pins in the slots, it is necessary to overcome the pre-torque force.

Once assembly of the apparatus is complete, it is installed on the chair in any of several different ways, none of which is intended to limit the scope of the present invention. For example, in the illustrated embodiment, the apparatus is installed by welding or otherwise affixing the center retainer and casings directly to the frame of the base, as shown in FIG. 10, and by welding or otherwise securing the end retainers to a frame 36 forming a part of the backrest, as illustrated in FIG. 2. The apparatus is oriented on the chair with the pins engaged with the ends of the slots closest to the base 12 such that the backrest is biased toward the upright position and is returned to that position after reclining pressure on the backrest is released.

When the backrest is upright, as shown in FIGS. 2 and 3, the end retainers remain in a first orientation dictated by the engagement of the pins 34 with the ends of the slots 32, and the torsion bar segments apply a torque to the end retainers that resist reclining movement of the backrest. However, when a user leans against the backrest with sufficient force to overcome the pre-torque, the backrest tilts rearward about the longitudinal axis of the apparatus. Such reclining movement is accommodated until the pins 34 engage the opposing ends of the slots 32, as shown in FIGS. 4 and 5. At this orientation, further reclining movement of the backrest is prevented, and the torsion bar segments exert an increased torque on the end retainers, biasing the backrest toward the upright position.

Alternately, the end retainers could be welded or otherwise affixed to the base of the chair, and the center retainer and casings could be secured to the backrest. In this embodiment, the apparatus is oriented on the chair with the pins engaged with the ends of the slots furthest from the seat such that the backrest is again biased toward the upright position and is returned to that position after reclining pressure on the backrest is released.

Although the present invention has been described with reference to the preferred embodiment illustrated in the attached drawing figures, it is noted that substitutions may be made and equivalents employed herein without departing from the scope of the invention. For example, although the means for restricting axial and rotational movement of the end retainers relative to the outer casings is illustrated with the pins 34 fixed in the end retainers 26 and being movable within slots 32 formed in the casings 24, it is possible to reverse this arrangement, fixing the pins in the casings and providing slots in the end retainers that accommodate a limited range of relative rotational movement of the casings. This alternate embodiment has the advantage of covering the slot and pin, and of protecting against a user being pinched between the pin and slot during reclining movement of the backrest.

Another alternate embodiment of the present invention is illustrated in FIGS. 7 and 8, and includes a pair of attachments 40 that are received on the end retainers 42 to facilitate construction of the apparatus on the chair. The end retainers 42 of the alternate construction differ from those described above in that each end retainer includes a longitudinal projection 44 that presents a non-circular cross-sectional shape, e.g. a hexagonal shape as illustrated in the figures.

The attachments 40 are formed of metal or any other suitable material, and are preferably identical to one another. Each attachment includes a proximal end into which a longitudinal bore is formed, wherein the bore is shaped to receive the projection 44 of one of the end retainers 42 so that the attachment and end retainer rotate together. A longitudinal bore 46 can be provided in each attachment that extends completely through the attachment and communicates with the non-circular bore to permit the attachment to be secured to the base or backrest of the chair by a conventional fastener, if desired. Alternately, the attachment can be welded to the base or backrest of the chair.

By providing the attachments 40, it is possible to assemble the attachments on the chair separately from the apparatus, and to install the apparatus simply by inserting the projections 44 of the apparatus into the attachments, without requiring further welding or attaching steps. In addition, this construction enables the apparatus to be swapped out for another should the apparatus need to be repaired or replaced by another having the same or a different pre-torque setting.

What is claimed is:

1. A tilt control apparatus for use on a chair having a base and a backrest, the apparatus comprising:

a center retainer including a pair of opposed axial ends and defining a longitudinal axis intersecting the ends;

a torsion bar segment protruding from each axial end of the center retainer along the longitudinal axis and including a distal end remote from the center retainer;

a tubular outer casing received over each torsion bar segment and affixed to the center retainer;

an end bar retainer received on the distal end of each torsion bar segment for rotation therewith; and a means for restricting axial and rotational movement of the end retainers relative to the outer casings, wherein the center retainer and outer casings are adapted for securement together to one of the base and backrest, and the end retainers are adapted for securement to the other of the base and backrest such that the backrest can be tilted relative to the base between an upright position and a tilted position, the torsion bar segments biasing the end retainers in a direction adapted to return the backrest to the upright position.

2. The tilt control apparatus as recited in claim 1, wherein the torsion bar segments are defined by a single torsion bar that extends through the center retainer.

3. The tilt control apparatus as recited in claim 1, wherein the torsion bar segments are defined by separate torsion bars that are each supported by the center retainer for rotation therewith.

4. The tilt control apparatus as recited in claim 1, wherein the torsion bar segments each include a non-circular cross-sectional shape.

5. The tilt control apparatus as recited in claim 1, wherein the center retainer includes a pair of axially opposed, small-diameter end sections sized for receipt of the outer casings, and a large-diameter central section having a non-circular cross-sectional shape.

6. The tilt control apparatus as recited in claim 1, wherein each of the outer casings presents an annular cross-sectional shape.

7. The tilt control apparatus as recited in claim 1, wherein each of the end bar retainers includes a proximal end section sized for receipt within one of the outer casings and including an axially extending aperture sized for receipt of the distal end of one of the torsion bar segments.

8. The tilt control apparatus as recited in claim 1, wherein the means for restricting axial and rotational movement of the end retainers relative to the outer casings includes a pin secured to and protruding radially from each of the end retainers, and a circumferentially extending slot defined by each of the outer casings and sized for receipt of one of the pins, the slots being elongated in the circumferential direction of the outer casings to restrict axial movement of the end retainer while permitting a limited range of rotational movement.

9. A method of assembling a tilt control apparatus for use on a chair having a base and a backrest, the method comprising the steps of:

mounting a pair of torsion bar segments on a center retainer including a pair of opposed axial ends through which a longitudinal axis extends, the torsion bar segments extending from the ends along the longitudinal axis and presenting distal ends remote from the center retainer;

sliding a tubular outer casing over each torsion bar segment, the tubular outer casings each including a distal end presenting a radially extending aperture;

fitting an end retainer on the distal end of each torsion bar segment for rotation therewith, the end retainers each including a radially extending aperture;

inserting pins through the apertures of the outer casings into the apertures of the end retainers to restrict axial and rotational movement of the end retainers relative to the outer casings;

rotating the center retainer relative to the outer casings and the end retainers to pre-torque the torsion bar segments; and securing the center retainer to the outer casings while maintaining the pre-torque on the torsion bar segments.

10. The method as recited in claim 9, wherein the step of mounting the pair of torsion bar segments on the center retainer includes inserting a single torsion bar through the center retainer so that the center retainer is disposed substantially one-half way between the distal ends of the torsion bar segments.

11. The method as recited in claim 9, wherein the step of mounting a pair of torsion bar segments on the center retainer includes mounting two separate torsion bars on the center retainer, the torsion bars each defining one of the torsion bar segments.

12. The method as recited in claim 9, wherein the center retainer includes a pair of axially opposed, small-diameter end sections over which the outer casings are received during the sliding step, the center retainer further including a large-diameter central section having a non-circular cross-sectional shape that protrudes from between the outer casings.

13. The method as recited in claim 9, wherein each of the end bar retainers includes a proximal end section that is received in one of the outer casings during the fitting step, and an axially extending aperture that receives the distal end of one of the torsion bar segments.

14. The method as recited in claim 9, wherein the apertures in the outer casings are slots that are elongated in the circumferential direction of the outer casings to restrict axial movement of the end retainer while permitting a limited range of rotational movement.

* * * * *